US007959848B2

(12) United States Patent
Reneker et al.

(10) Patent No.: US 7,959,848 B2
(45) Date of Patent: Jun. 14, 2011

(54) METHOD AND DEVICE FOR PRODUCING ELECTROSPUN FIBERS

(75) Inventors: Darrell H. Reneker, Akron, OH (US); George Chase, Wadsworth, OH (US); Oludotun Dosunmu, Akron, OH (US); Woraphon Kataphinan, Akron, OH (US)

(73) Assignee: The University of Akron, Akron, OH (US)

( * ) Notice: Subject to any disclaimer, the term of this patent is extended or adjusted under 35 U.S.C. 154(b) by 600 days.

(21) Appl. No.: 11/913,073

(22) PCT Filed: May 3, 2006

(86) PCT No.: PCT/US2006/016961

§ 371 (c)(1),
(2), (4) Date: Apr. 28, 2008

(87) PCT Pub. No.: WO2007/086910

PCT Pub. Date: Aug. 2, 2007

(65) Prior Publication Data

US 2008/0237934 A1 Oct. 2, 2008

Related U.S. Application Data

(60) Provisional application No. 60/677,173, filed on May 3, 2005.

(51) Int. Cl.

| | |
|---|---|
| ***B29C 33/40*** | (2006.01) |
| ***D01D 4/02*** | (2006.01) |
| ***D01D 7/00*** | (2006.01) |
| ***D06M 10/00*** | (2006.01) |
| ***H05B 7/00*** | (2006.01) |

(52) U.S. Cl. ..... 264/465; 264/219; 425/174.8 E; 425/175; 425/377; 425/382.2; 425/464

(58) Field of Classification Search ..... 264/219, 264/465; 425/174.8 E, 175, 377, 382.2, 464
See application file for complete search history.

(56) References Cited

U.S. PATENT DOCUMENTS

| | | | |
|---|---|---|---|
| 1,975,504 | A | 10/1934 | Formhals |
| 6,616,435 | B2 | 9/2003 | Lee et al. |
| 6,641,773 | B2 | 11/2003 | Kleinmeyer et al. |
| 6,753,454 | B1 | 6/2004 | Smith et al. |
| 2005/0123688 | A1 * | 6/2005 | Craighead et al. ..... 427/469 |

FOREIGN PATENT DOCUMENTS

| | | | |
|---|---|---|---|
| WO | 02092888 | A | 11/2002 |
| WO | 2004016839 | A | 2/2004 |

OTHER PUBLICATIONS

Reneker, D.H. and I. Chun, "Nanometer Diameter Fibers of Polymer, Produced by Electrospinning", Nanotechnology, 7, 216 to 223, 1996.
Reneker, D.H., A.L. Yarin, H. Fong, & S. Koombhongse, Bending Instability of Electrically Charged Liquid Jets of Polymer Solutions . . . , J. Appl., Phys. 87, 4531, 2000.
Yarin, A.L., S. Koombhongse, and D.H. Reneker, "Bending Instability in Electrospinning of Nanofibers", J. Appl. Phys, 89,3018, 2001.
Hohman, M.M., M. Shin, G. Rutledge, and M.P. Brenner, Electrospinning and Electrically Forced Jets: II Applications, Phys. Fluids 13, 2221, 2001.
Yarin, A.L., E. Zussman, "Upward Needless Electrospinning of Multiple Nanofibers", Polymer, 45, 2977 to 2980, 2004.

* cited by examiner

*Primary Examiner* — Leo B Tentoni
(74) *Attorney, Agent, or Firm* — Daniel J. Schlue; Roetzel & Andress

(57) ABSTRACT

The present invention relates to methods for producing fibers made from one or more polymers or polymer composites, and to structures that can be produced from such fibers. In one embodiment, the fibers of the present invention are nanofibers. The present invention also relates to apparatus for producing fibers made from one or more polymers or polymer composites, and methods by which such fibers are made.

19 Claims, 20 Drawing Sheets

Cutaway view showing the cylindrical porous nozzle within the cylindrical collector.

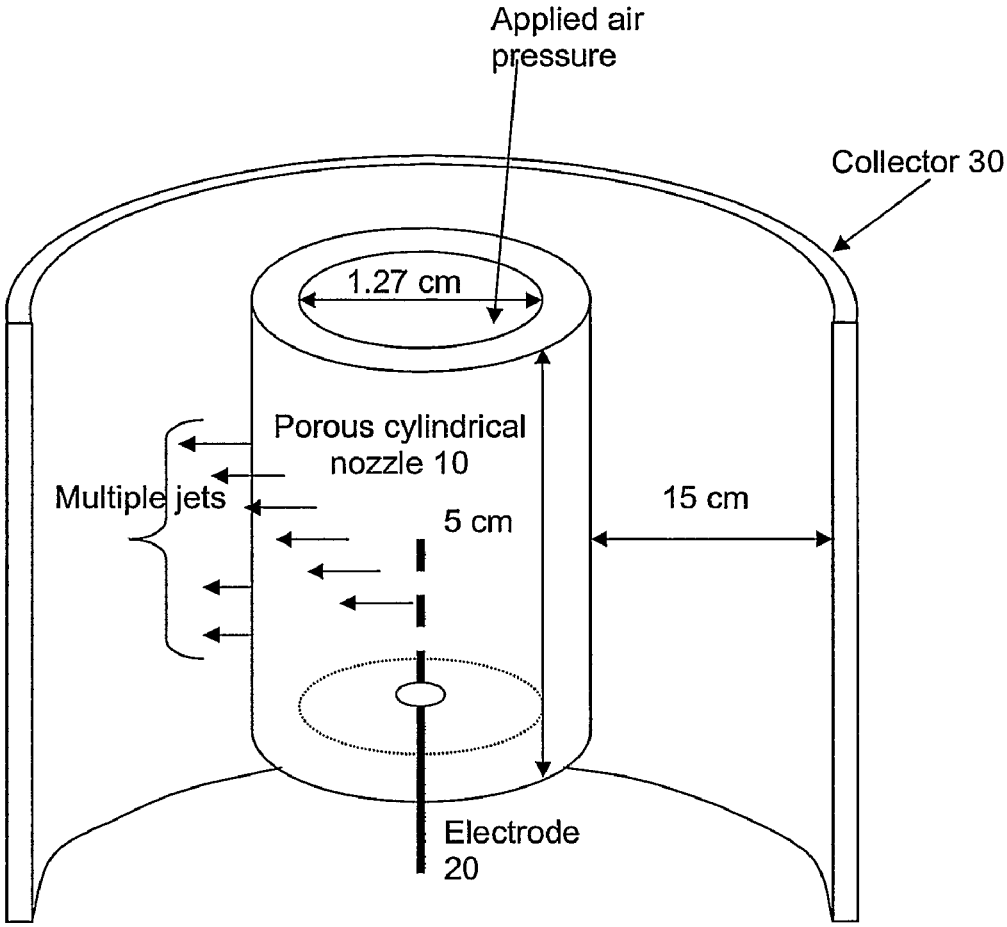
Figure 1: Cutaway view showing the cylindrical porous nozzle within the cylindrical collector.

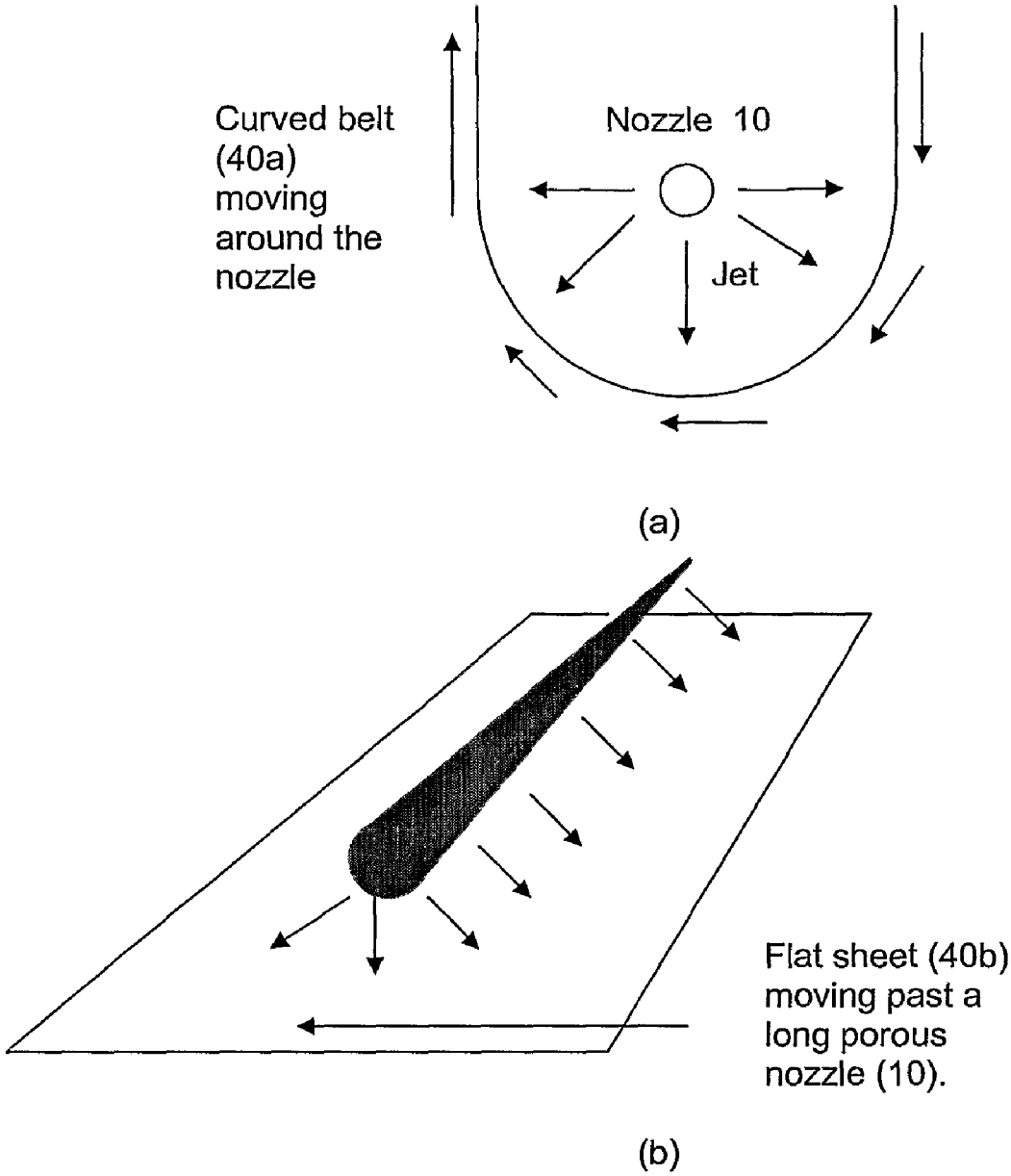
Figure 2: The collector could be constructed as a moving belt for collecting large sheets of fibers. The belt could move around the nozzle as shown in (a) or may be a flat sheet as shown in (b). (b) shows the porous nozzle as a long tube (or conical tube).

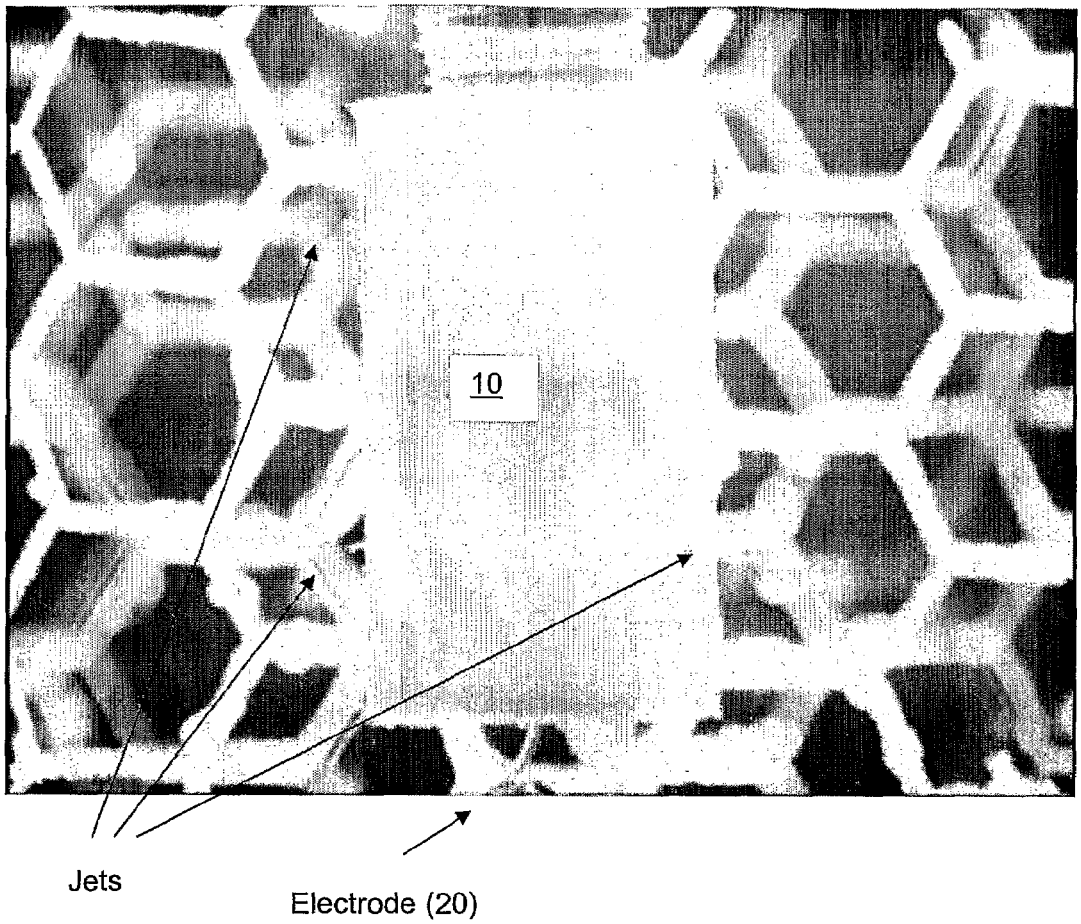
Figure 4a. The porous nozzle sits in the center of a cylindrical wire mesh. Jets of Nylon 6 solution protrude from the walls of the nozzle. The wire electrode enters the nozzle from the bottom.

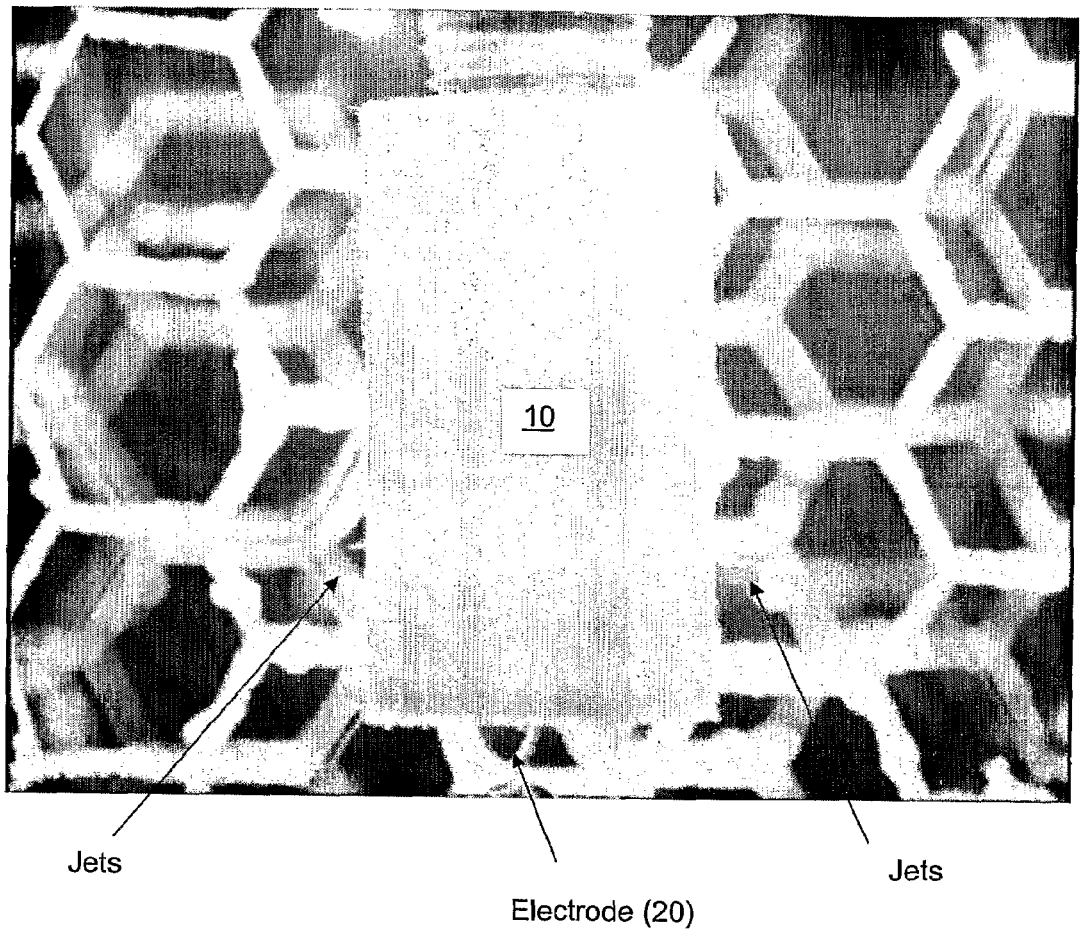
Figure 4b. The porous nozzle sits in the center of a cylindrical wire mesh. Jets of Nylon 6 solution protrude from the walls of the nozzle.

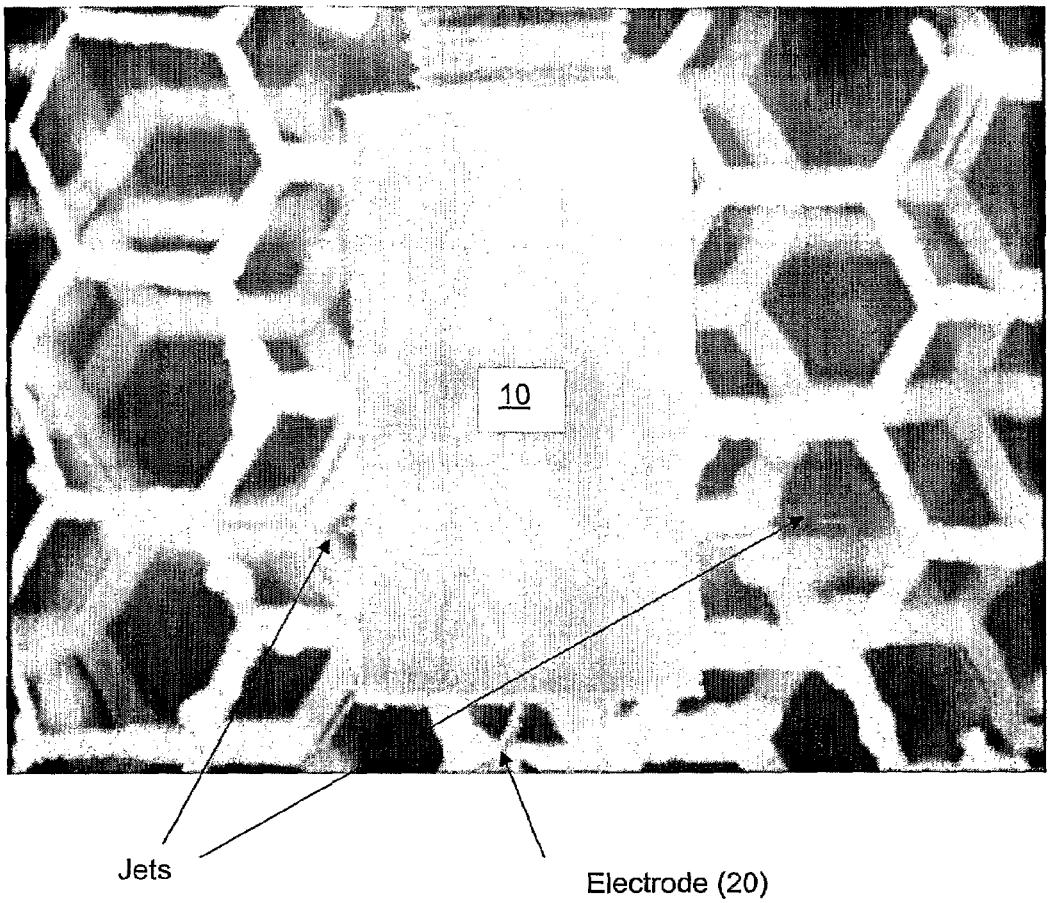
Figure 4c. The porous nozzle sits in the center of a cylindrical wire mesh. Jets of Nylon 6 solution protrude from the walls of the nozzle.

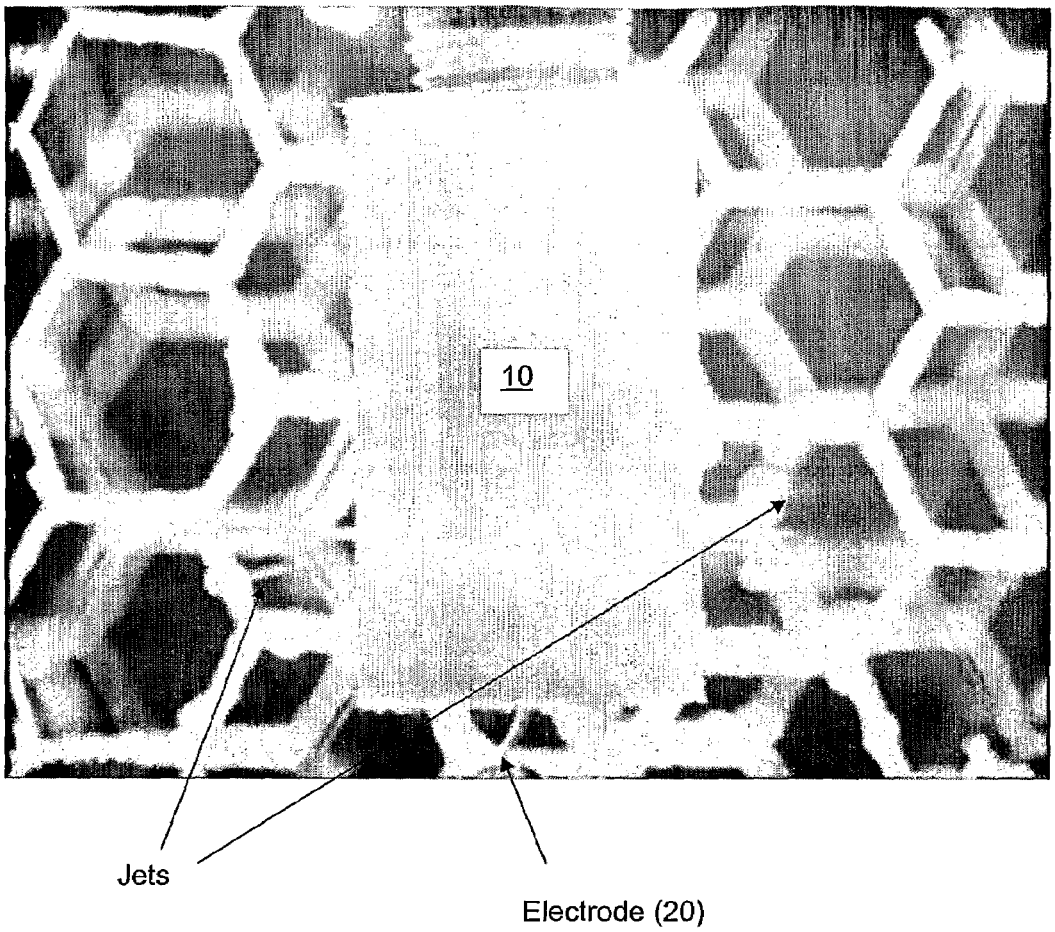
Figure 4d. The porous nozzle sits in the center of a cylindrical wire mesh. Jets of Nylon 6 solution protrude from the walls of the nozzle.

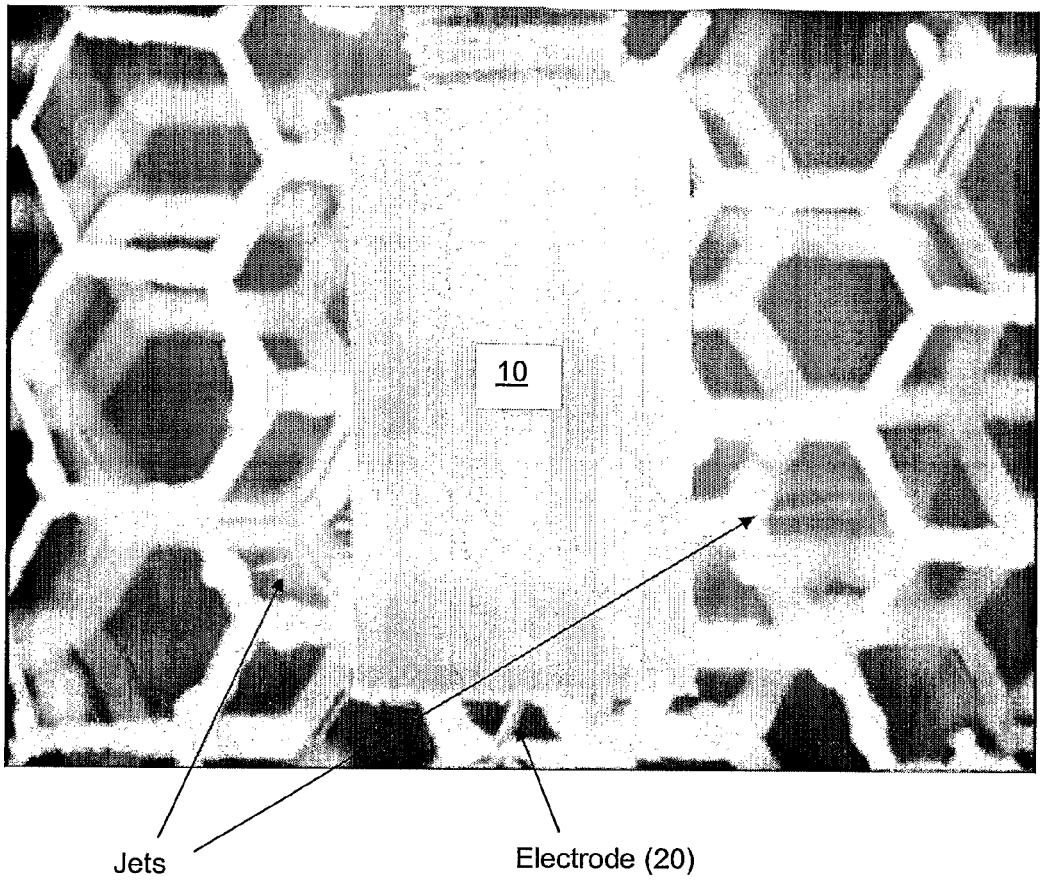
Figure 4e. The porous nozzle sits in the center of a cylindrical wire mesh. Jets of Nylon 6 solution protrude from the walls of the nozzle.

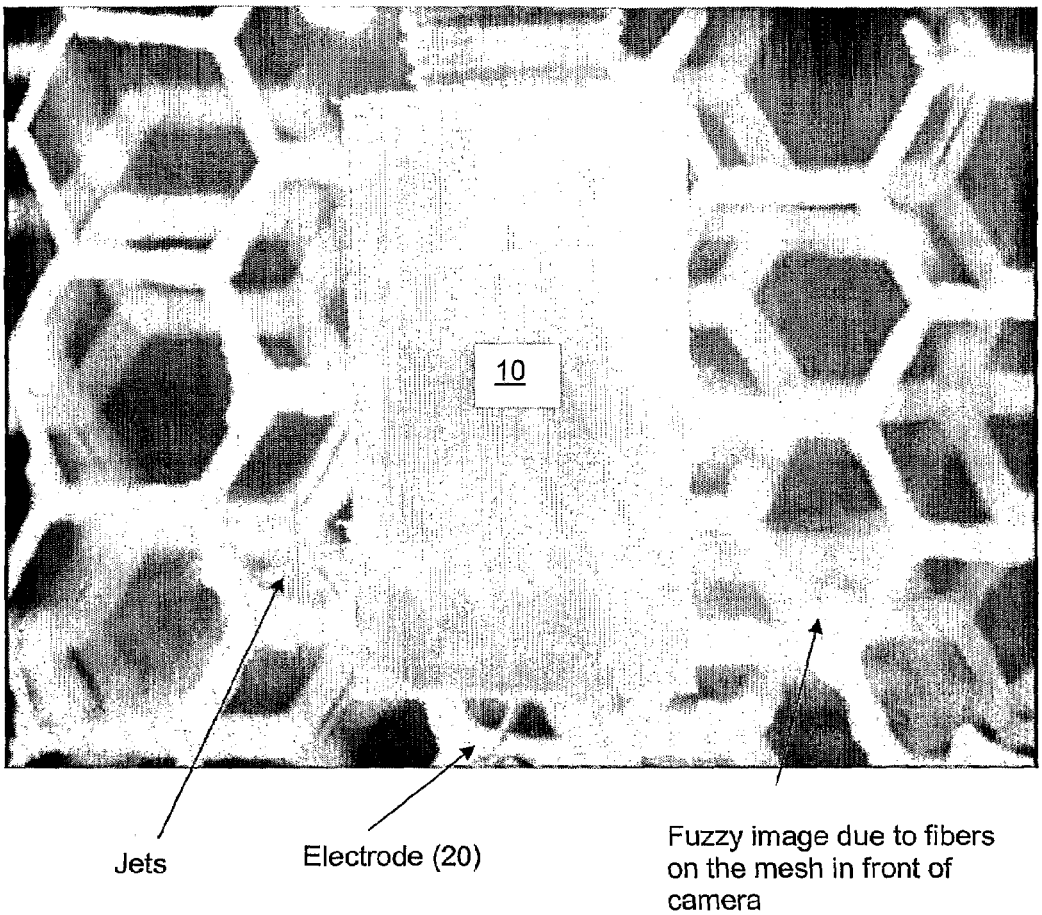
Figure 4f. The porous nozzle sits in the center of a cylindrical wire mesh. Jets of Nylon 6 solution protrude from the walls of the nozzle.

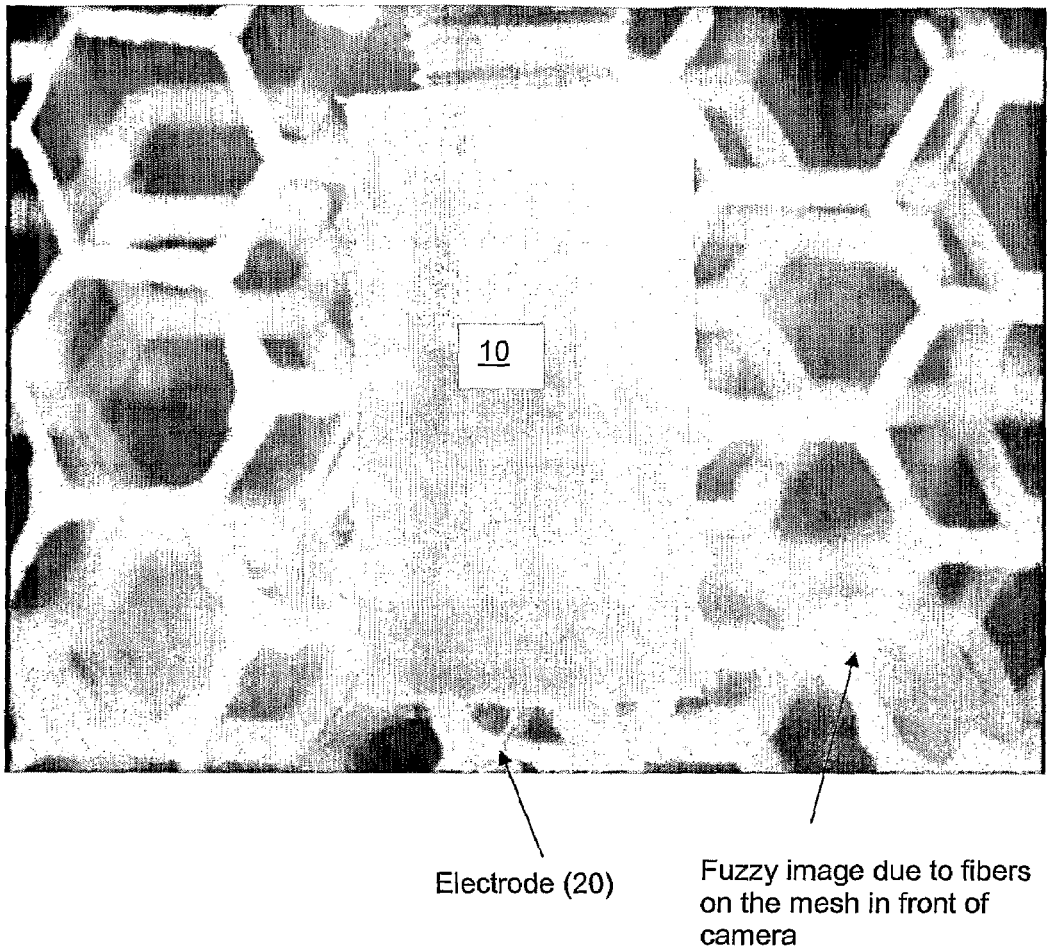
Figure 4g. The porous nozzle sits in the center of a cylindrical wire mesh. Jets of Nylon 6 solution protrude from the walls of the nozzle.

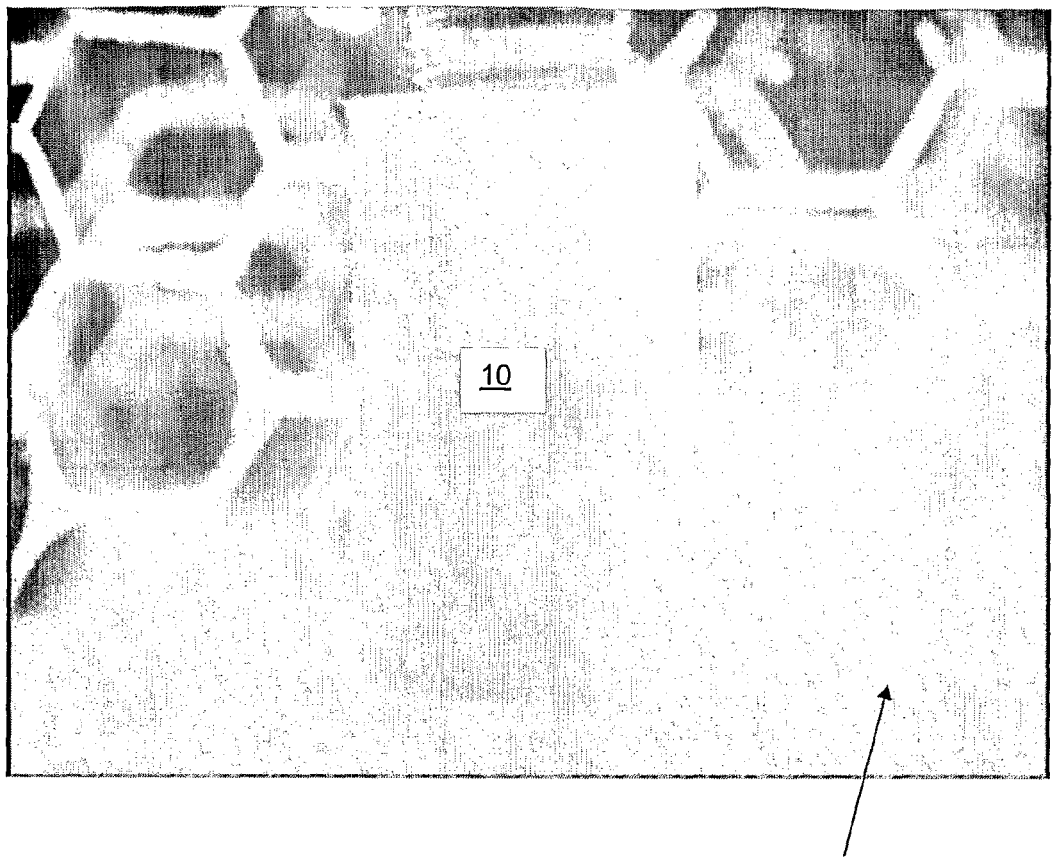
Fuzzy image due to fibers on the mesh in front of camera
Figure 4h. The porous nozzle sits in the center of a cylindrical wire mesh. Jets of Nylon 6 solution protrude from the walls of the nozzle.

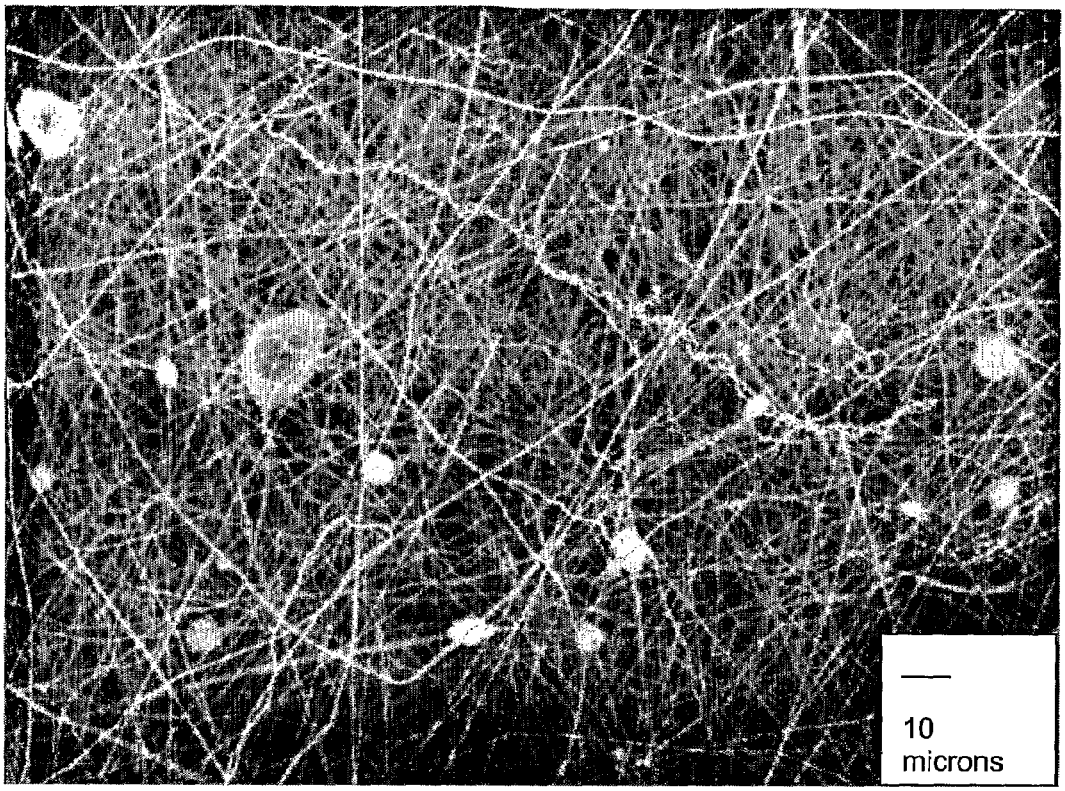
Figure 5a. SEM image of Nylon 6 fibers produced by electrospinning from a porous nozzle.

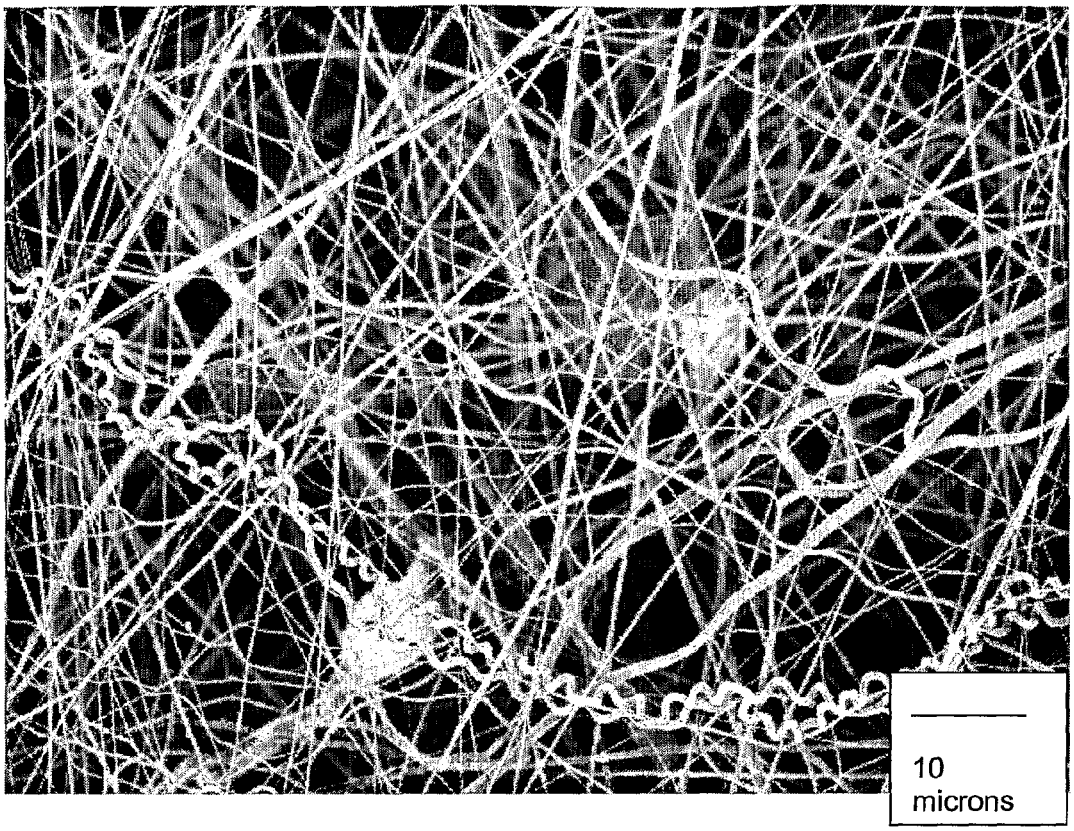
Figure 5b. SEM image of Nylon 6 fibers produced by electrospinning from a porous nozzle.

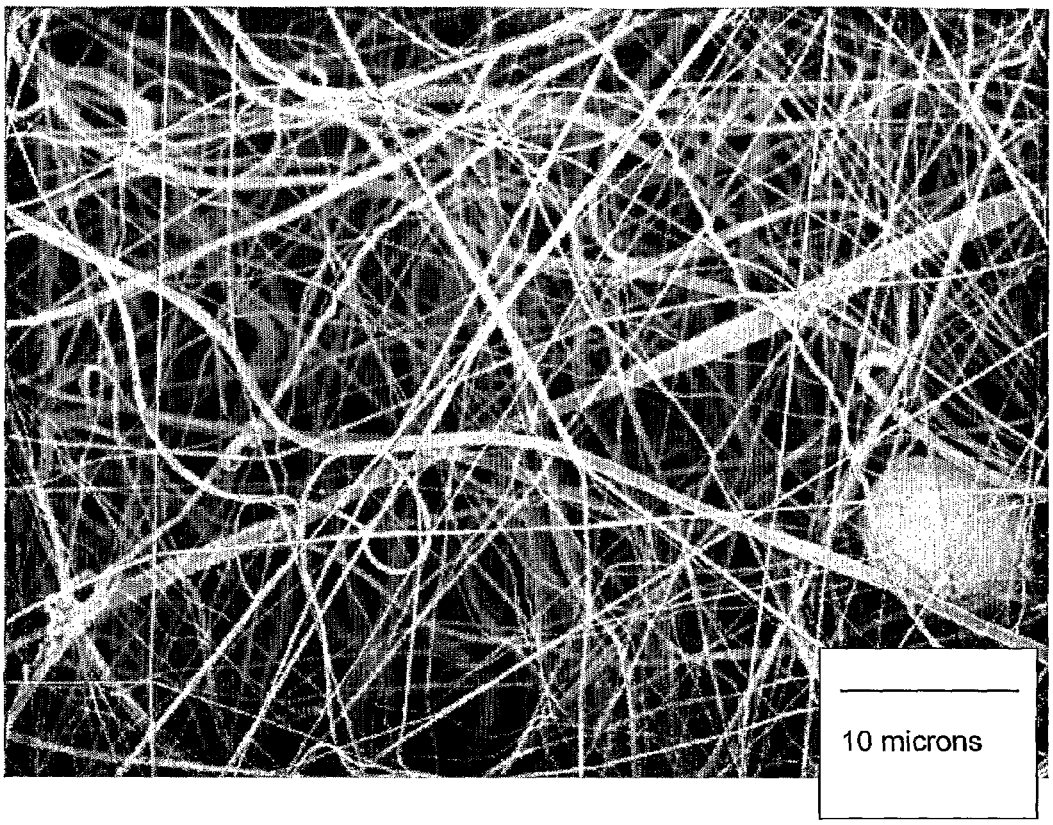
Figure 5c. SEM image of Nylon 6 fibers produced by electrospinning from a porous nozzle.

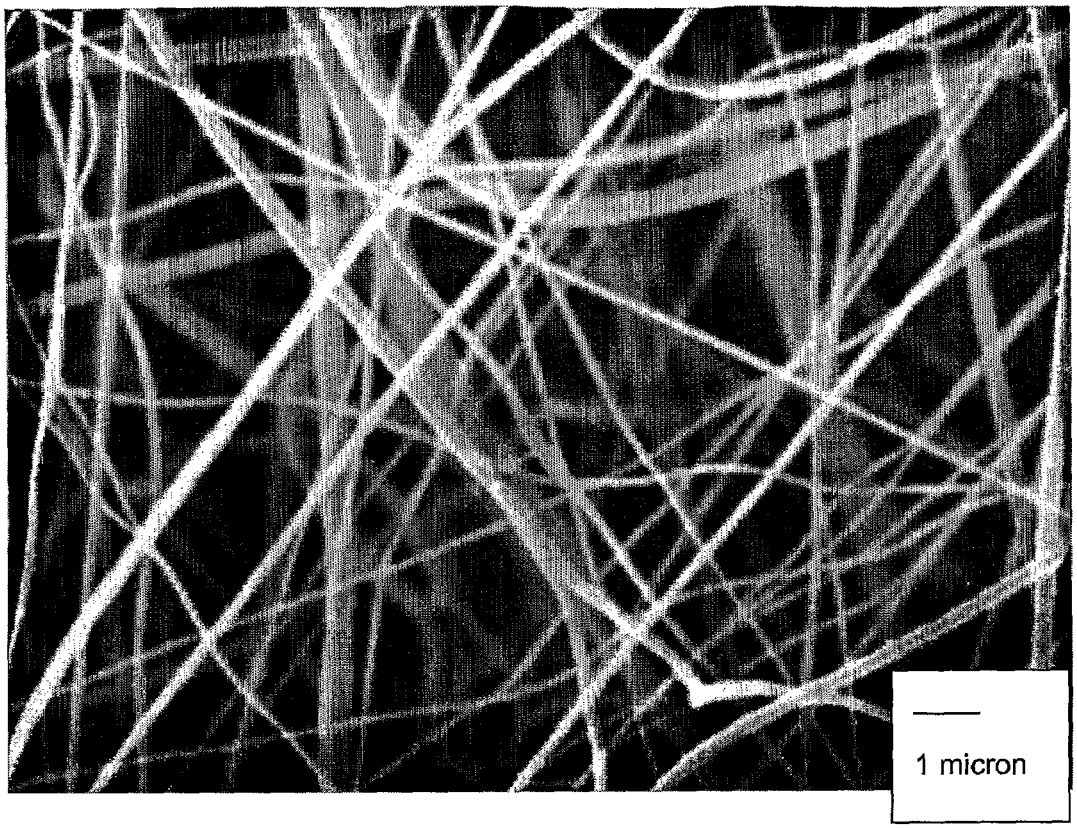
Figure 5d. SEM image of Nylon 6 fibers produced by electrospinning from a porous nozzle.

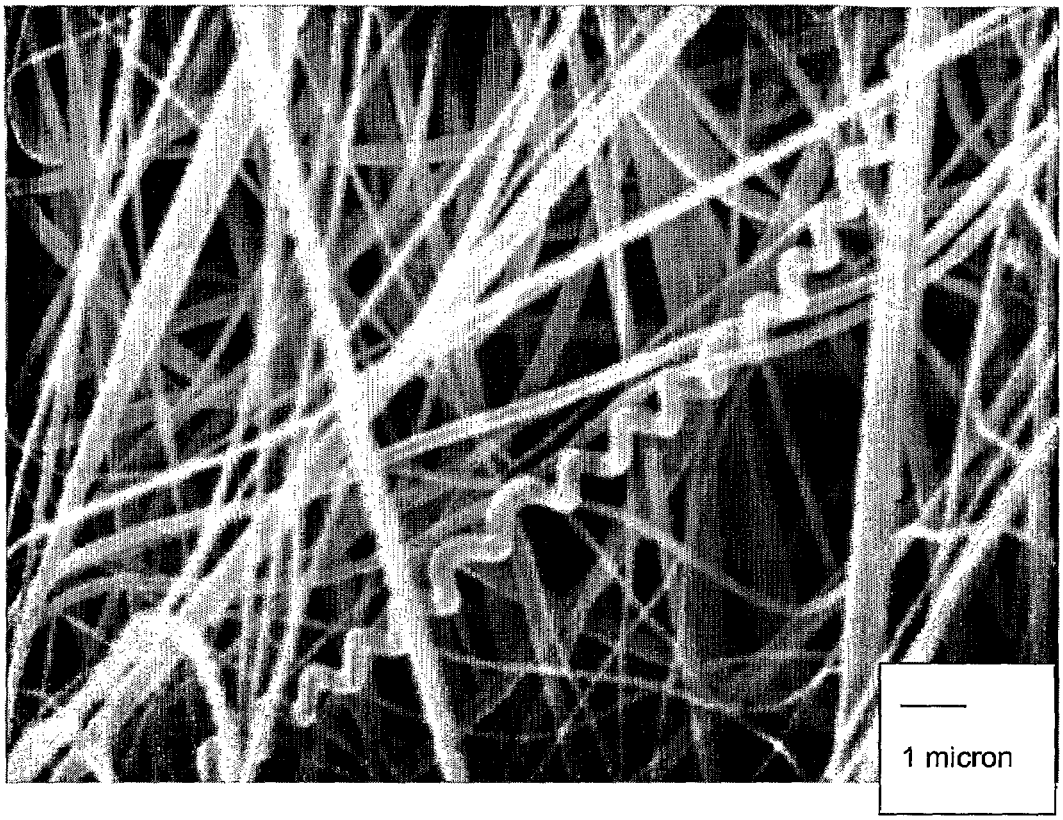
Figure 5e. SEM image of Nylon 6 fibers produced by electrospinning from a porous nozzle.

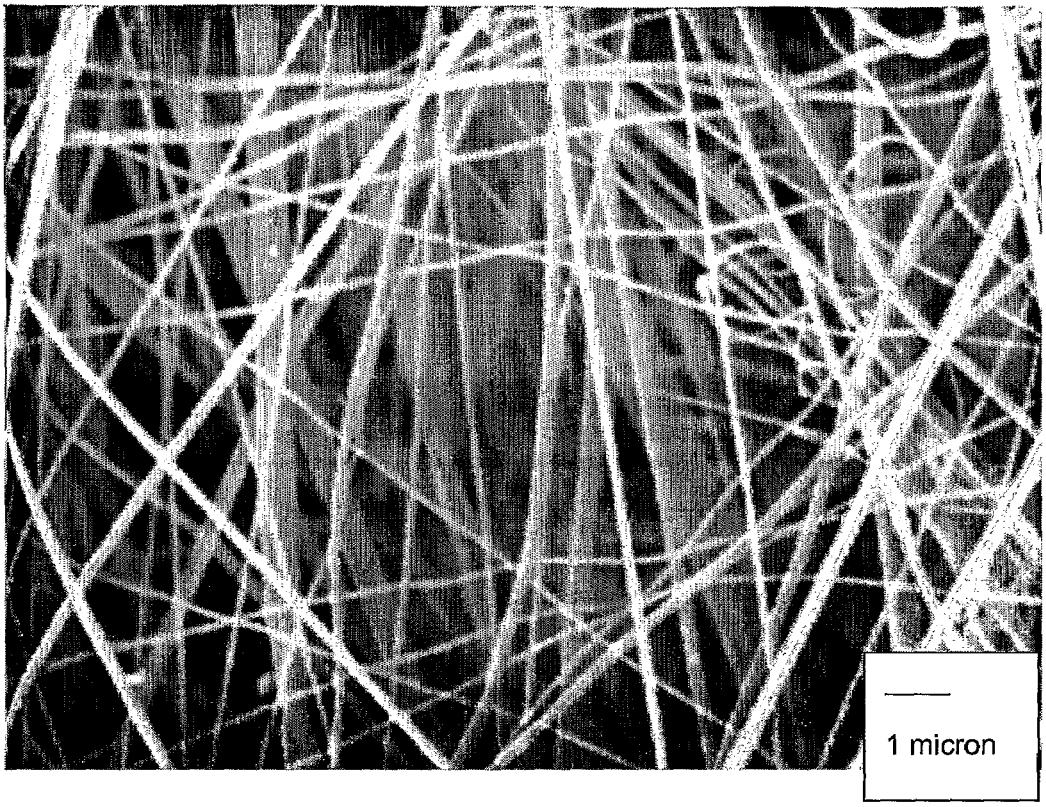
Figure 5f. SEM image of Nylon 6 fibers produced by electrospinning from a porous nozzle.

METHOD AND DEVICE FOR PRODUCING ELECTROSPUN FIBERS

FIELD OF THE INVENTION

The present invention relates to methods for producing fibers made from one or more polymers or polymer composites, and to structures that can be produced from such fibers. In one embodiment, the fibers of the present invention are nanofibers. The present invention also relates to apparatus for producing fibers made from one or more polymers or polymer composites, and methods by which such fibers are made.

BACKGROUND OF THE INVENTION

The demand for nanofibers and nanofiber technology has grown in the past few years. As a result, a reliable source for nanofibers, as well as economical methods to produce nanofibers, have been sought. Uses for nanofibers will grow with improved prospects for cost-efficient manufacturing, and the development of and/or expansion of significant markets for nanofibers is almost certain in the next few years. Currently, nanofibers are already being utilized in the high performance filter industry. In the biomaterials area, there is a strong industrial interest in the development of structures to support living cells (i.e., scaffolds for tissue engineering). The protective clothing and textile applications of nanofibers are of interest to the designers of sports wear, and to the military, since the high surface area per unit mass of nanofibers can provide a fairly comfortable garment with a useful level of protection against chemical and biological warfare agents. Also of interest is the use of nanofibers in the production of packaging, food preservation, medical, agricultural, batteries, electrical/semiconductor applications and fuel cell applications, just to name a few.

Carbon nanofibers are potentially useful in reinforced composites, as supports for catalysts in high temperature reactions, heat management, reinforcement of elastomers, filters for liquids and gases, and as a component of protective clothing. Nanofibers of carbon or polymer are likely to find applications in reinforced composites, substrates for enzymes and catalysts, applying pesticides to plants, textiles with improved comfort and protection, advanced filters for aerosols or particles with nanometer scale dimensions, aerospace thermal management application, and sensors with fast response times to changes in temperature and chemical environment. Ceramic nanofibers made from polymeric intermediates are likely to be useful as catalyst supports, reinforcing fibers for use at high temperatures, and for the construction of filters for hot, reactive gases and liquids.

Of interest is the ability to manufacture sufficient amounts of nanofibers, and if desirable, create products and/or structures that use and/or contained such fibers. Production of nanostructures by electrospinning from polymeric material has attracted much attention during the last few years. Although other production methods have been used to produce nanofibers, electrospinning is a simple and straightforward method of producing both nanofibers and/or nanostructures.

The nanostructures produced to date have ranged from simple unstructured fiber mats, wires, rods, belts, spirals and rings to carefully aligned tubes. The materials also vary from biomaterials to synthetic polymers. The applications of the nanostructures themselves are quite diverse. They include filter media, composite materials, biomedical applications (tissue engineering, scaffolds, bandages, drug release systems), protective clothing, micro- and optoelectronic devices, photonic crystals and flexible photocells.

Electrospinning, which does not depend upon mechanical contact, has proven advantageous, in several ways, to mechanical drawing for generating thin fibers. Although electrospinning was introduced by Formhals in 1934 (Formhals, A., "Process and Apparatus for Preparing Artificial Threads," U.S. Pat. No. 1,975,504, 1934), interest in the method was revived in the 1990s. Reneker (Reneker, D. H. and I. Chun, *Nanometer Diameter Fibers of Polymer, Produced by Electrospinning*, Nanotechnology, 7, 216 to 223, 1996) has demonstrated the fabrication of ultra thin fibers from a broad range of organic polymers.

Fibers are formed from electrospinning by uniaxial elongation of a viscoelastic jet of a polymer solution or melt. Up to 1993 the method was known as electrostatic spinning. The process uses an electric field to create one or more electrically charged jets of polymer solution from the surface of a fluid to a collector surface. A high voltage is applied to the polymer solution (or melt), which causes a charged jet of the solution to be drawn toward a grounded collector. The jet elongates and bends into coils as reported in ((1) Reneker, D. H., A. L. Yarin, H. Fong, and S. Koombhongse, *Bending Instability of Electrically Charged Liquid Jets of Polymer Solutions in Electrospinning*, J. Appl. Phys, 87, 4531, 2000; (2) Yarin, A. L., S. Koombhongse, and D. H. Reneker, *Bending Instability in Electrospinning of Nanofibers*, J. Appl. Phys, 89, 3018, 2001; and (3) Hohman, M. M., M. Shin, G. Rutledge, and M. P. Brenner, *Electrospinning and Electrically Forced Jets: II. Applications*, Phys. Fluids 13, 2221, 2001). The thin jet solidifies as the solvent evaporates, to form nanofibers with diameters in the submicron range that deposit on the grounded collector.

The viscoelastic jets are often derived from drops that are suspended at the tip of a needle, which is fed from a vessel filled with polymer solution. This arrangement typically produces a single jet with the mass rate of fiber deposition from a single jet being relatively slow (hundredths or tenths of grams per hour). To significantly increase the production rate of this design multiple jets from many needles are required. A multi-needle arrangement can be inconvenient due to its complexity. Yarin and Zussman (Yarin, A. L., E. Zussman, *Upward Needless Electrospinning of Multiple Nanofibers*, Polymer, 45, 2977 to 2980, 2004) report on a novel attempt to produce multiple jets using a layer of ferromagnetic suspension, under a magnetic field, beneath a layer of polymer solution in order to perturb the inter layer surface and consequently produce multiple jets on the surface. Yarin and Zussman also reported a potential 12 fold increase in production rate over a comparable multi-needle arrangement. This arrangement also is quite complex and a continuous operation will be a challenge. Therefore, a simpler approach is desired that would permit, among other things, the increased production of fibers and/or nanofibers.

U.S. Pat. No. 6,753,454 discloses a method for producing fibers by electrospinning that permits the formation of polymer fibers that contain a pH adjusting compound and are used to produce a wound dressing or other product.

Also of interest is the ability to embed/sequester on, in, or about a nanofiber one or more therapeutic, active and/or chemical agents. Accordingly, there is a need for a method or methods that would permit the production of fibers, and in particular nanofibers. Additionally, there is a need for a method or methods that would permit the production of nanofibers that allow for the inclusion of, embedding in, and/or coating of the polymer fibers with one or more of a wide variety of therapeutic, active and/or chemical agents.

SUMMARY OF THE INVENTION

The present invention relates to methods for producing fibers made from one or more polymers or polymer composites, and to structures that can be produced from such fibers. In one embodiment, the fibers of the present invention are nanofibers. The present invention also relates to apparatus for producing fibers made from one or more polymers or polymer composites, and methods by which such fibers are made.

In one embodiment, the present invention relates to an electrospinning apparatus for forming fibers comprising: one or more nozzles having at least one pore or hole formed in each of the one or more nozzles; a means for supplying at least one fiber-forming media to one or more nozzles; at least one electrode for supplying a charge to the one or more nozzles; and a collection means for collecting fibers.

In another embodiment, the present invention relates to an electrospinning apparatus, wherein the one or more nozzles utilized in the apparatus are formed from two mesh cylinders, a first mesh cylinder having a first interior diameter and a first exterior diameter, the first interior diameter and the first exterior diameter being different, and a second mesh cylinder having a second interior diameter and a second exterior diameter, the second interior diameter and the second exterior diameter being different, wherein the exterior diameter of the second mesh cylinder is less than the interior diameter of the first mesh cylinder such that the second mesh cylinder can be inserted into the interior of the first mesh cylinder.

In still another embodiment, the present invention relates to a process for forming fibers, the process comprising the steps of: (a) supplying, under pressure, a fiber-forming media to one or more nozzles, each nozzle having at least one pore or hole formed therein; (b) supplying a charge, via a charge supplying means, to the one or more nozzles containing the fiber-forming media; and (c) collecting fibers formed from the one or more nozzles.

BRIEF DESCRIPTION OF THE DRAWINGS

FIG. 1 is a cross-section schematic diagram of an apparatus for producing fibers, nanofibers, and/or fiber or nanofiber structures according to the present invention;

FIGS. 2*a* and 2*b* are schematic drawings of two types of collectors utilized to collected fibers and/or nanofibers produced in accordance with the present invention;

FIGS. 4*a* to 4*h* are photographs of a porous cylindrical nozzle for use in the production of fibers and/or nanofibers according to the present invention. The nozzles of FIGS. 3*a* to 3*h* are used in conjunction with a wire mesh collector;

FIGS. 5*a* to 5*f* are photographs of nanofibers produced using a method in accordance with the present invention.

DETAILED DESCRIPTION OF ILLUSTRATIVE EMBODIMENTS

Figure 3A:
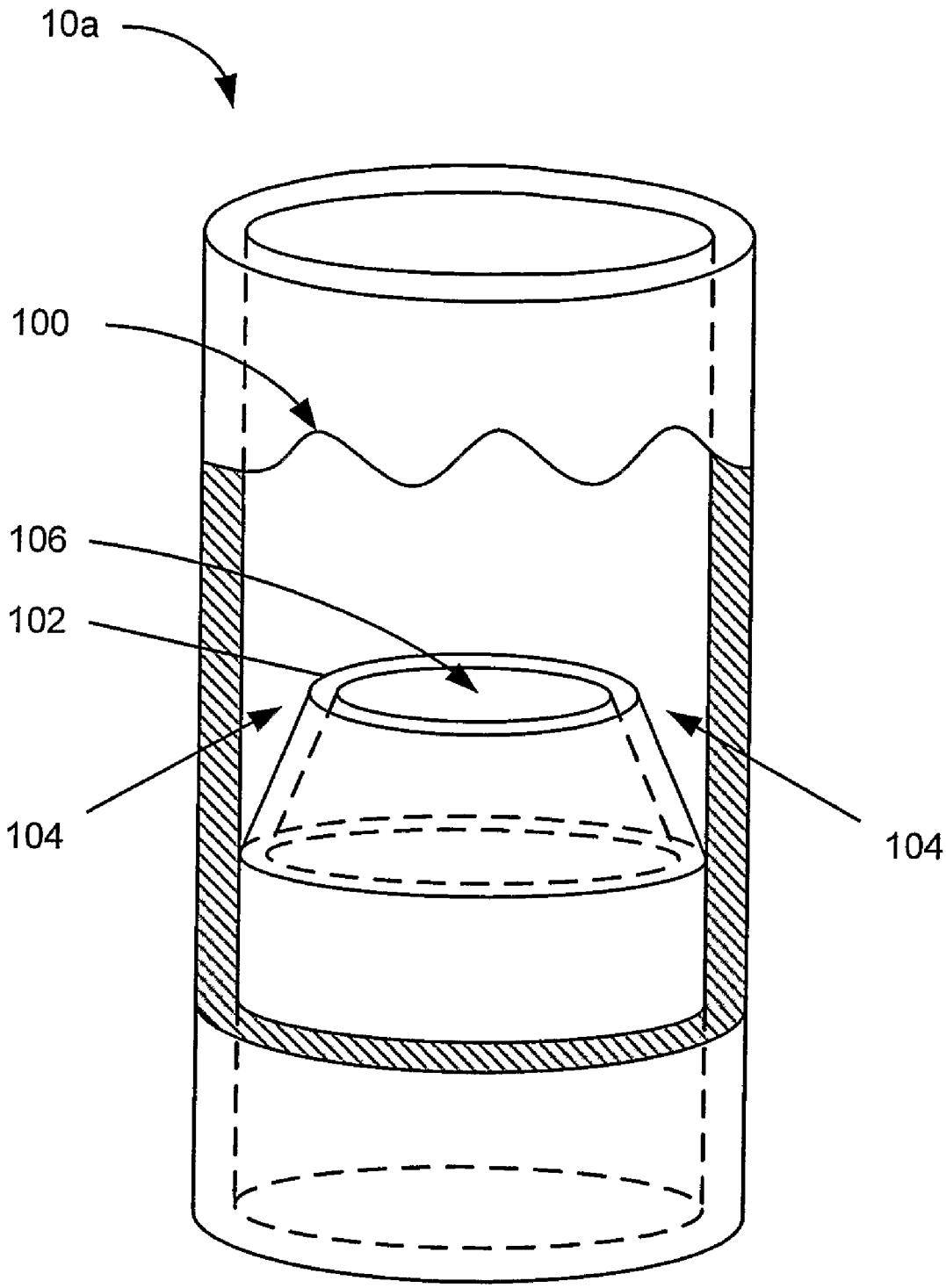
FIGS. 3*a* to 3*c* are schematic illustrations of alternative embodiments for a nozzle utilized in conjunction with the present invention.

As used herein nanofibers are fibers having an average diameter in the range of about 1 nanometer to about 25,000 nanometers (25 microns). In another embodiment, the nanofibers of the present invention are fibers having an average diameter in the range of about 1 nanometer to about 10,000 nanometers, or about 1 nanometer to about 5,000 nanometers, or about 3 nanometers to about 3,000 nanometers, or about 7 nanometers to about 1,000 nanometers, or even about 10 nanometers to about 500 nanometers. In another embodiment, the nanofibers of the present invention are fibers having an average diameter of less than 25,000 nanometers, or less than 10,000 nanometers, or even less than 5,000 nanometers. In still another embodiment, the nanofibers of the present invention are fibers having an average diameter of less than 3,000 nanometers, or less than about 1,000 nanometers, or even less than about 500 nanometers. Additionally, it should be noted that here, as well as elsewhere in the text, ranges may be combined.

As is noted above, the present invention relates to methods for producing fibers made from one or more polymers or polymer composites, and to structures that can be produced from such fibers. In one embodiment, the fibers of the present invention are nanofibers. The present invention also relates to apparatus for producing fibers made from one or more polymers or polymer composites, and methods by which such fibers are made. In one embodiment, the present invention relates to a method and apparatus designed to produce fibers and/or nanofibers at an increased rate of speed. In one instance, the apparatus of the present invention utilizes an appropriately shaped porous structure, in conjunction with a liquid fiber-producing media (or fiber-forming liquid), to produce fibers and/or nanofibers.

As is illustrated in FIG. 1, in one embodiment an electrospinning apparatus according to present invention utilizes a cylindrically-shaped porous nozzle 10 to produce the desired fibers and/or nanofibers. Although not illustrated in FIG. 1, nozzle 10 is connected via any suitable means to a supply of liquid media/fiber-forming liquid from which the desired fibers are to be produced. The liquid media is supplied usually under pressure via, for example, a pump to nozzle 10. Although other supply systems could be used depending upon the type of liquid fiber-producing media being used (or the fiber-forming media's chemical and/or physical properties).

The pressure at which the liquid fiber-producing media is supplied to nozzle 10 depends, in part, upon the type of liquid material that is being used to produce the desired fibers. For example, if the liquid media has a relatively high viscosity, more pressure may be necessary to push the liquid media through the pores of nozzle 10 in order to produce the desired fibers. In another embodiment, if the liquid media has a relatively low viscosity (about the same as, lower than, or slightly higher than that of water), less pressure may be needed to push the liquid media through the pores of nozzle 10 in order to produce the desired fibers. Accordingly, the present invention is not limited to a certain range of pressures.

Any compound or composite compound (i.e., any mixture, emulsion, suspension, etc. of two or more compounds) that can be liquefied can be used to form fibers and/or nanofibers in accordance with the present invention. Such compounds and/or composites include, but are not limited to, molten pitch, polymer solutions, polymer melts, polymers that are precursors to ceramics, molten glassy materials, and suitable mixtures thereof. Some exemplary polymers include, but are not limited to, nylons, fluoropolymers, polyolefins, polyimides, polyesters, polycaprolactones, and other engineering polymers, or textile forming polymers.

In the embodiment where a polymer compound or composite is being used to form the liquid media of the present invention, generally speaking a pressure of less than about 5 psig can be used to push the liquid media through the pores of nozzle 10. Although, as stated above, the present invention is not limited to only pressures of 5 psig or less. Rather, any suitable pressure can be utilized depending upon the type of liquid media being pushed/pumped/supplied to nozzle 10.

Nozzle 10 is made from any suitable material taking into consideration the compound or composite compound that is being used, or that is going to be used, to produce fibers in accordance with the present invention. Accordingly, there are no limitations on the compound or compounds used to form nozzle 10, the only necessary feature for nozzle 10 is that the nozzle be able to withstand the process conditions necessary to liquefy the compound or composite compound that is being used to produce the fibers of the present invention. Accordingly, nozzle 10 can be formed from any material, including, but not limited to, a ceramic compound, a metal or metallic alloy, or a polymer/co-polymer compound. As noted above, in one embodiment nozzle 10 is porous. In another embodiment, nozzle 10 can be made from a solid material that has holes formed therein. These holes can be arranged in any pattern, be the pattern regular or irregular. For example, nozzle 10 could be formed by joining two cylinders made from a mesh screen together, with each mesh screen independently having a regular or irregular pattern of holes formed therein. By varying the patterns and/or the distance between the two mesh cylinders, any number of hybrid holes can be formed. For example, by off-setting two cylindrical screens having circular shaped holes therein, it is possible to form a nozzle 10 with elliptically-shaped through pores. Given the above, the present invention is not limited to any one hole pattern or hole geometry, rather any desired hole pattern or hole geometry can be used.

In still another embodiment, nozzle 10 can be formed from a porous material and have one or more holes formed therein. Alternatively, the holes formed in nozzle 10 do not necessarily have to be formed completely through the wall(s) of nozzle 10. That is, partial indents can be formed on the exterior and/or interior surfaces of nozzle 10 by any suitable means (e.g., drilling, casting, punching, etc.). In this case, the partial holes formed on one or more surfaces of nozzle 10 lower the resistance to fiber forming in the areas of nozzle 10 around any such partial holes. As such, greater control over the fiber formation process can be obtained.

The size of the pores formed in nozzle 10 is not critical. While not wishing to be bound to any one theory, it should be noted that the size of the pores and/or holes in nozzle 10 have, in one embodiment, minimal impact upon the size of the fibers produced in accordance with the present invention. Instead, in one instance, fiber size is controlled by a combination of factors that include, but are not limited to, (1) the size of the one or more droplets that form on the outside surface of nozzle 10 that give "birth" to the jets of fiber forming media and/or material that are shown in, for example FIGS. 4*a* to 4*g*; (2) the pressure of the fiber forming fluid inside nozzle 10, the existence and size of any internal structures, as will be discussed in detail below, within and/or on the interior of nozzle 10; and (3) the amount, if any, of fiber forming fluid that is re-circulated from the interior of nozzle 10 and the pressure associated with any such recirculation.

In one embodiment, nozzle 10 is formed from a polypropylene rod having pores therein ranging in size from about 10 to about 20 microns. However, as noted above, the present invention is not limited thereto. Rather, as noted above, any porous material that is unaffected by the fluid to be used for fiber production can be used without affecting the result (e.g., porous metal nozzles). The number of pores in nozzle 10 is not critical; any number of pores can be formed in nozzle 10 depending upon the desired rate of fiber production. In one embodiment, nozzle 10 has at least about 10 pores, at least about 100 pores, at least about 1,000 pores, at least about 10,000 pores, or even less than about 100,000 pores. In still another embodiment, nozzle 10 has less than about 20 pores, less than about 100 pores, less than about 1,000 pores, or even less than about 10,000 pores.

With reference again to FIG. 1, the size of nozzle 10 is not critical. As shown in the embodiment of FIG. 1, nozzle 10 has an inner diameter of 1.27 cm and a height of 5 cm. However, nozzle 10 is not limited to only the dimensions disclosed in FIG. 1. Rather, any size nozzle can be used in the apparatus of the present invention depending upon such factors as desired fiber diameter, fiber length, fiber compound/composite, and/or fiber-containing structure that is being produced.

Also included in the apparatus of FIG. 1 is an electrode 20 that is placed in electrical contact with nozzle 10. As is illustrated in FIG. 1, electrode 20 is placed on and partially through the bottom surface of nozzle 10. However, the present invention is not limited to solely the arrangement shown in FIG. 1. Rather, any other suitable arrangement that permits electrical connectivity between nozzle 10 and electrode 20 can be used. As would be apparent to those of skill in the art, electrode 20 provides to nozzle 10 (and in effect the fiber-forming liquid contained therein) the electrical charge necessary to form fibers and/or nanofibers by an electrospinning process.

Upon application of a charge to the desired fiber-forming liquid, the fibers produced in the apparatus of FIG. 1 are attracted to collector 30. Generally, collector 30 is grounded, thereby promoting the electrical attraction between the charged fiber-forming structures emanating from the one or more pores of nozzle 10 and collector 30. Although collector 30 is shown as a cylinder-shaped collector, the present invention is not limited thereto. Any shape collector can be utilized. For example, as is shown in FIG. 2, alternative collectors 40*a* and 40*b* can be formed in the shape of a curved belt 40*a* or a sheet 40*b*. Additionally, the collector of the present invention can be stationary or movable. In the case where the collector is movable, the fibers formed in accordance with the present invention can be more easily produced on a continuous basis. Again, the size of collector 30 is not critical. Any size collector can be used depending upon the size of nozzle 10, the diameter and/or length of fibers to be produced, and/or other process parameters. As is shown in FIG. 2, nozzle 10 can also be an elongated cone-shaped nozzle or a spherical-shaped nozzle. Again, the shape of nozzle 10 is not limited to shapes disclosed herein. Rather, nozzle 10 can be any desired 3-dimensional shape.

The diameter of the fibers of the present invention can be adjusted by controlling various conditions including, but not limited to, the size of the pores in nozzle 10. The length of these fibers can vary widely to include fibers that are as short as about 0.0001 mm up to those fibers that are about many km in length. Within this range, the fibers can have a length from about 1 mm to about 1 km, or even from about 1 cm to about 1 mm.

Figure 3B:
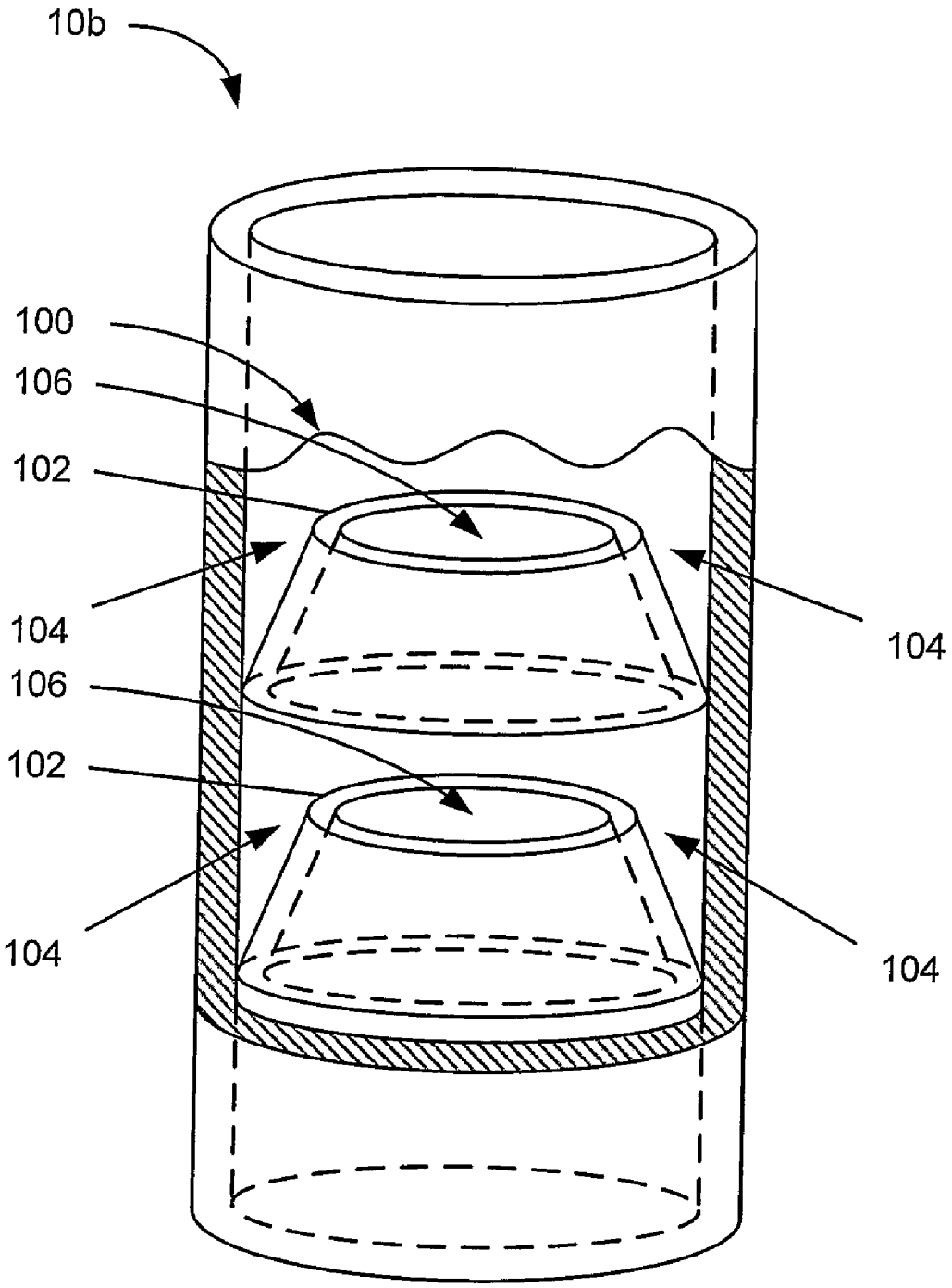

In another embodiment, nozzle 10 can be include one or more interior cones, shelves, or lips formed on and/or attached to the interior surface of nozzle 10. As shown in cut-away section 100 of FIG. 3*a*, nozzle 10*a* includes a cone 102 that is connected and/or mounted within the interior of nozzle 10. Cone 102 forms a catch 104 that is designed to collect fiber forming media/material thereon. Once catch 104 becomes full the fiber forming material (not shown) will overflow through opening 106 in cone 102 and drip down towards the bottom of nozzle 10*a*, which is similar in structure to the bottom of nozzle 10. In another embodiment, as is shown in FIG. 3*b*, nozzle 10*b* has two of more cones 102 formed in the interior thereof. Although embodiments with one or two interior cones are shown, the present invention is not limited thereto. Instead, any number of cones, shelves or lips can be used in conjunction with nozzles 10, 10*a*, or 10*c*. In still another embodiment, the interior surface of nozzle 10 can include one or more spiral-shaped or helix-shaped troughs. In this embodiment, a spiral-shaped or helix-shaped wire can be located in the catches created within the interior of nozzle 10 by the one or more spiral-shaped or helix-shaped troughs.

Figure 3C:
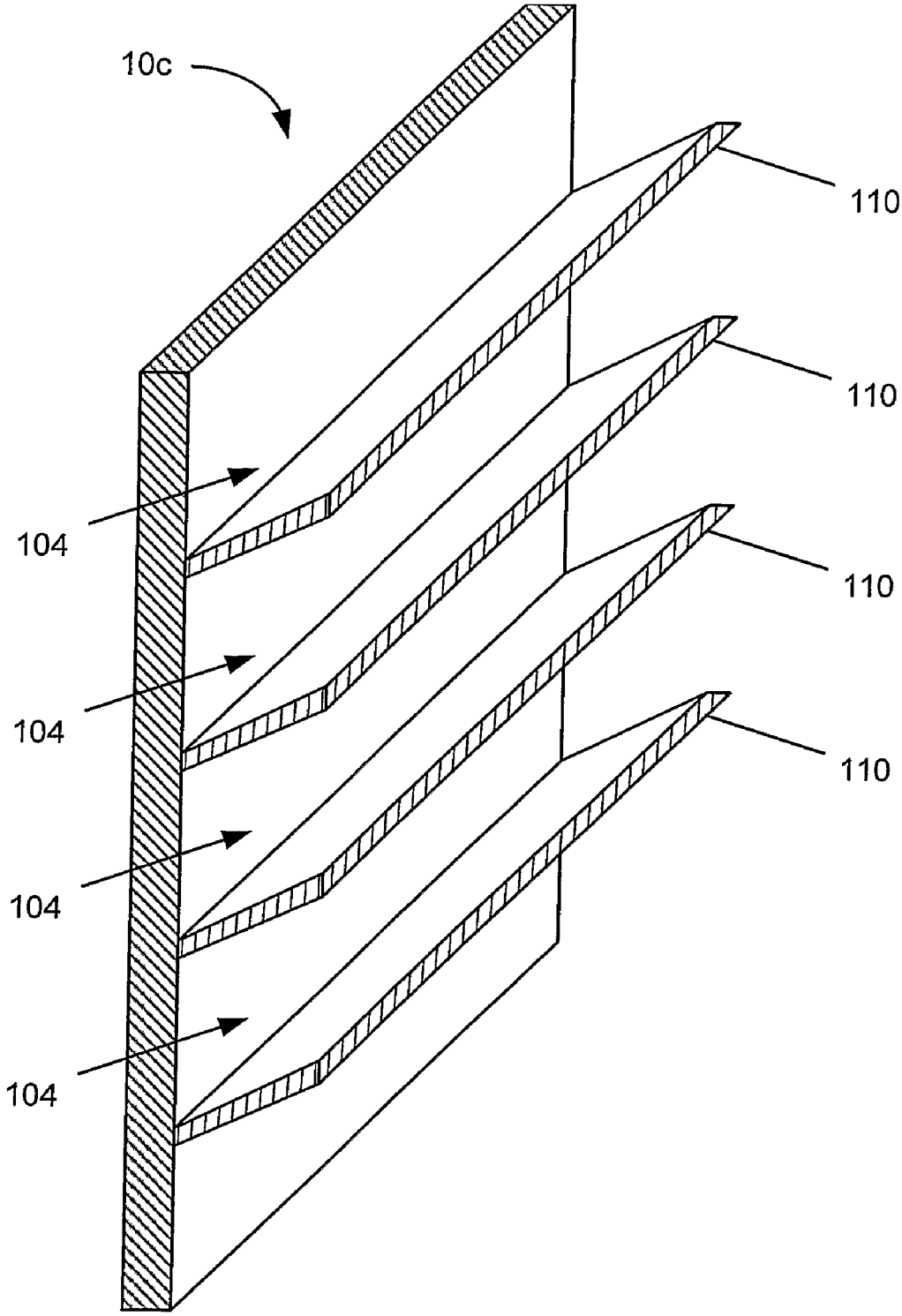

Turning to FIG. 3*c*, one side of a three dimensionally-shaped polygon nozzle 10*c* is shown. In this embodiment, nozzle 10*c* has at least three sides (i.e. a nozzle having a triangular cross-section). As would be appreciated by those of skill in the art, in this embodiment nozzle 10*c* can have a polygonal cross-sectional shape with the number of sides being any number greater than 3. In the embodiment of FIG. 3*c*, at least one shelf 110 is formed on one or more interior surfaces of nozzle 10*c* and each shelf 110 is able to hold fiber forming media and/or liquid in one or more catches 104. In one embodiment, each shelf 110 is continuously formed on all the interior surfaces of nozzle 10*c*. That is, in this embodiment each shelf 110 is a polygon-shaped "cone" similar to cones 102 of FIGS. 3*a* and 3*b*. Although FIG. 3*c* illustrates an embodiment with four interior shelves, the present invention is not limited thereto. Instead, any number of cones, shelves or lips can be used in conjunction with nozzle 10*c*. In still another embodiment, a coiled wire or spring is inserted in the interior of nozzles 10, 10*a*, 10*b* or 10*c* (not shown).

Due in part to the use of one or more interior structures within nozzles 10, 10*a*, 10*b* or 10*c*, it is possible to more accurately control and/or adjust the pressure of the fiber forming media/material being provided to the nozzle of the present invention. As is discussed above, the present invention is not limited to any specific range of pressure needed to form fibers in accordance with the method disclosed herein. Rather, any range of pressures can be used including pressures greater than or less than atmospheric pressure, and such ranges depend largely upon the size of the pores or holes in the nozzle and the viscosity of the fiber forming media or fluid. In another embodiment, the pressure necessary to form fibers in accordance with a method of the present invention can be further controlled by altering the number of shelves, cones or lips formed on the interior surface of nozzles 10, 10*a*, 10*b*, or 10*c*, and/or altering the depth of the one or more catches 104 created by the one or more shelves, cones or lips formed on the interior surface of nozzles 10, 10*a*, 10*b*, or 10*c*.

In one embodiment of the present invention nozzles 10, 10*a*, 10*b* and 10*c* are fitted with a fluid recovery system at the bottom end thereof. Such a fluid recovery system permits excess fiber forming media/material to be re-circulated thereby allowing for greater control of the pressure within nozzles 10, 10*a*, 10*b* or 10*c*.

A fiber forming apparatus in accordance with the present invention includes at least one nozzle in accordance with the present invention. In another embodiment, the fiber forming apparatus of the present invention includes at least about 5 nozzles, at least about 10 nozzles, at least about 20 nozzles, at least about 50 nozzles, or even at least about 100 nozzles in accordance with the present invention. In still another embodiment, any number of nozzles can be utilized in the fiber forming apparatus of the present invention depending upon the amount of fibers to be produced. It should be noted that each nozzle and/or any group of nozzles can be designed to be independently controlled. This permits, if so desired, the production of different sized fibers simultaneously. Additionally, different types of nozzles can be used simultaneously in order to obtain a mixture of fibers having various fiber-geometries and/or sizes.

EXAMPLES

A 20% wt Nylon 6 solution is pushed at about 5 psig or less through the pores of nozzle 10. Multiple jets of fiber-forming media develop from the surface of nozzle 10 (see FIGS. 4*a* to 4*g*) fed by the liquid fiber-forming media flowing through the pores of nozzle 10. In the embodiments shown in FIGS. 4*a* to 4*h* nozzle 10 is porous on the lower portion thereof. However, as noted above, nozzle 10 can, if so desired, be porous throughout the any or all of the cylindrical height of nozzle 10. The fibers formed via the apparatus picture in FIGS. 4*a* to 4*h* are nanofibers having nanoscale diameters as described above. Sometimes the fibers break away from the surface of nozzle 10 prior to reaching the collector 30 (e.g., the chicken-mesh type structure shown in the background of FIGS. 4*a* to 4*h*). This is not a problem. Instead, such fibers just have short lengths. The length of the fibers can, to a certain degree, be controlled by the amount of current applied via electrode 20 and/or the electric or ground state of collector 30.

The Nylon 6 for use in the apparatus of FIG. 4*a* to 4*h* is prepared as follows. Nylon 6 from Aldrich is used as received. A polymer solution having a concentration ranging 20 to 25 weight percent is prepared by dissolving the polymer in 88% formic acid (Fisher Chemicals, New Jersey, USA).

Nozzle 10 for use in the embodiments of FIGS. 4*a* to 4*h* is generally, a porous plastic product that is manufactured from a thermoplastic polymer. In this case the thermoplastic polymer is high density polyethylene (HDPE), ultra-high molecular weight polyethylene (UHMW), polypropylene (PP), or combinations thereof (although other polymers or materials can be used to form nozzle 10, as is described above). In this embodiment, nozzle 10 has an intricate network of interconnected pores (although any configuration of pores is within the scope of the present invention). In the case where a polymer is used to form nozzle 10, a selected particle size distribution among the particles of polymer used to form nozzle 10 usually produces a characteristic range of pore structures and pore sizes.

Figure 6:
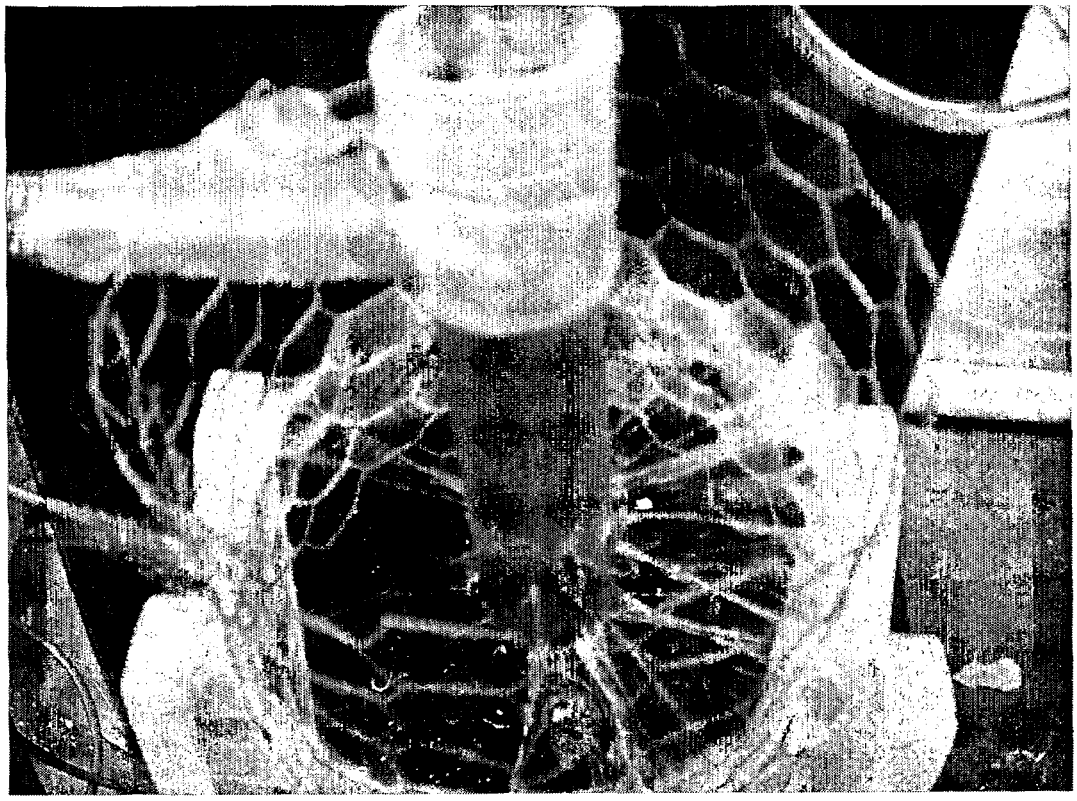
FIG. 6 is a photograph showing nanofibers that are produced using a method in accordance with the present invention.

In the case of the present examples, porous polypropylene having pore sizes of about 10 to 20 microns are used to construct a cylindrical nozzle 10 shown in FIGS. 1 and 4*a* to 4*h*. The cylinder has an internal diameter of one-half inch, and external diameter of one inch, with the bottom end sealed and the top fitted with a fitting for applying air pressure. An electrode 20 is inserted through the bottom surface for applying the voltage to the polymer solution within the nozzle 10. FIG. 6 is another photograph that shows fiber being produced in accordance with the present invention.

In one embodiment, the pores in nozzle 10 have sufficient resistance to the flow of unpressurized fiber-forming media (e.g., polymer solution), to prevent jets from forming on the exterior of nozzle 10 prior to the application of pressure to the fiber-forming media. The resistance to flow is caused by the small diameter of the pores of the porous wall and by the thickness of the porous wall. The polymer solution flow through the wall is controlled by the applied pressure at the top of the nozzle. Such pressure can be produced by any suitable means (e.g., a pump, the use of air or some other gas that does not react with the fiber-forming material). A slow controlled flow rate allows the formation of independent droplets at many points on the surface of the porous nozzle 10. The solution flows through the pores and droplets grow on the surface until any number of independent jets form. The pressure to nozzle 10 should be applied in such a manner that the droplets do not spread on the surface of nozzle 10, thereby becoming interconnected and failing to form at least a significant amount of independent jets.

As is discussed above, it is possible to use materials having smaller pore sizes to form the porous nozzle 10 of the present invention. The method by which the pores are formed in nozzle 10 is not critical (pores may be formed by sintering, etching, laser drilling, mechanical drilling, etc.). Generally speaking, the smaller the pores in nozzle 10, the smaller the diameter of fibers produced via the apparatus of the present invention.

In one instance, the polymer material flows through pores in a sintered metal nozzle 10, yielding a thin coating of fiber-forming media on the surface of nozzle 10 from which jets of fiber-forming media emerged at the outer surface of the coating and flowed away from the coated surface of nozzle 10.

In another instance, it is observed that fiber-forming media flows through the pores of nozzle 10 and creates discrete droplets on the surface of nozzle 10. The droplets continue to grow until the electrical field causes an electrically charged jet of solution to emanate from the droplets. The jet carries fluid away from a droplet faster that fluid arrives at the droplet through the pores, so that the droplet shrinks and the jet becomes smaller and stops. Then the electric field causes a new jet to emanate from another droplet and the process repeats.

As a source for electrode 20, a variable high voltage power supply (0 to 32 kV) can be used as a power supply (although the present invention is not limited thereto). The polymer solution is placed in the nozzle. Compressed air is the source of pressure used to push the polymer through the porous walls of nozzle 10.

The polymer solution flows slowly through the walls and forms small drops on the outside of the walls. With the aid of the electric field the drops form jets that flow towards the collector. The jets that form may be stable for a period of time or the jets may be intermittent, disappearing as the drop decreases in size due to a jet of polymer leaving the drop, and possibly reforming when the drop reappears.

In the present examples, the collector 30 is a cylindrical mesh of chicken wire coaxial with the nozzle and surrounding the nozzle. The cylindrical collector 30 has a diameter of about 6 inches.

As is discussed above, the present invention is not limited to just the use of a "chicken-wire" type collector 30, or to a cylindrically-shaped nozzle 10. Instead, any 3-dimensional shape can be used for nozzle 10. Additionally, other shapes/types of collectors can be utilized in an apparatus in accordance with the present invention.

Furthermore, in one embodiment, part of nozzle 10 can be impermeable and part permeable to direct the flow of the fibers towards a particular part of the collector. The collector surface may be curved or flat. The collector may move as a belt around or past the nozzle to collect a large sheet of fibers from the nozzle, as shown in FIG. 2.

Several jets that lasted for a period of time (many minutes) and many intermittent jets that lasted for much shorter periods of time are formed all over the surface of the nozzle as seen in FIGS. 4*a* to 4*h*. The fibers formed are collected on a cylindrical wire mesh surrounding the nozzle. FIGS. 4*f* to 4*h* are not as clear due to the presence of the fibers on the mesh blocking the view of the camera.

FIGS. 5*a* to 5*f* are SEM images of samples of fibers manufactured from the apparatus depicted in FIGS. 4*a* to 4*h*. The images show clearly that the fibers produced are nanofibers of dimensions (of less than about 100 nm to about 1000 nm in diameter) and are comparable to those produced from a conventional needle arrangement. Fibers in this size range are suitable for many purposes including, but not limited to, packaging, food preservation, medical, agricultural, batteries and fuel cell applications.

The production rate of nanofibers is large compared to a single needle arrangement electrospinning apparatus. A typical needle produces nanofibers at a rate of about 0.02 g/hr. The porous nozzle used in this experiment produced nanofibers at a rate greater than about 5 g/hr or a production rate of about 250 times greater.

The present process is readily applicable to any polymer solution or melt that can be electrospun via a needle arrangement. The porous nozzle material must be chemically compatible with the polymer solution.

The present invention can also be used to add any desired chemical, agent and/or additive on, in or about fibers produced via electrospinning. Such additives include, but are not limited to, pesticides, fungicides, anti-bacterials, fertilizers, vitamins, hormones, chemical and/or biological indicators, protein, growth factors, growth inhibitors, antioxidants, dyes, colorants, sweeteners, flavoring compounds, deodorants, processing aids, etc.

The pores in sintered materials can be smaller than the diameters of needles often used for electrospinning. Smaller diameter pores may make it possible to make smaller diameter fibers. Thus, the present invention makes possible the use of materials having pores of sizes much smaller than even those discussed in the examples above.

An increase in the production rate is also possible with the present invention without having to place in close proximity a large number of needles for electrospinning. The presence of a large amount of needles in close proximity can affect the geometry of the electric field used in electrospinning and can cause one or more jets to form from some needles and not from others.

Although the invention has been described in detail with particular reference to certain embodiments detailed herein, other embodiments can achieve the same results. Variations and modifications of the present invention will be obvious to those skilled in the art and the present invention is intended to cover in the appended claims all such modifications and equivalents.

What is claimed is:

1. An electrospinning apparatus for forming fibers comprising:

one or more nozzles having at least one pore or hole formed in each of the one or more nozzles;

a means for supplying at least one fiber-forming media to one or more nozzles:

at least one electrode for supplying a charge to the one or more nozzles; and a collection means for collecting fibers, wherein the one or more nozzles are formed from two mesh cylinders, a first mesh cylinder having a first interior diameter and a first exterior diameter, the first interior diameter and the first exterior diameter being different, and a second mesh cylinder having a second interior diameter and a second exterior diameter, the second interior diameter and the second exterior diameter being different, wherein the exterior diameter of the second mesh cylinder is less than the interior diameter of the first mesh cylinder such that the second mesh cylinder can be inserted into the interior of the first mesh cylinder.

2. The apparatus of claim 1, wherein the apparatus has at least about 5 nozzles, and each nozzle can be independently controlled is so desired.

3. The apparatus of claim 1, wherein the apparatus has at least about 10 nozzles, and each nozzle can be independently controlled is so desired.

4. The apparatus of claim 1, wherein the apparatus has at least about 20 nozzles, and each nozzle can be independently controlled is so desired.

5. The apparatus of claim 1, wherein the apparatus has at least about 100 nozzles, and each nozzle can be independently controlled is so desired.

6. The apparatus of claim 1, wherein the one or more nozzles each have at least one cone, shelf or lip formed on an interior surface thereof.

7. The apparatus of claim 1, wherein the one or more nozzles are cylindrical in shape.

8. The apparatus of claim 1, wherein the one or more nozzles are independently polygon-shaped nozzles having at least three sides.

9. The apparatus of claim 1, wherein the fibers are nanofibers.

10. The apparatus of claim 9, wherein the nanofibers have an average diameter in the range of about 1 nanometer to about 25,000 nanometers.

11. The apparatus of claim 9, wherein the nanofibers have an average diameter in the range of about 1 nanometer to about 3,000 nanometers.

12. A process for forming fibers, the process comprising the steps of:

(a) supplying, under pressure, a fiber-forming media to one or more nozzles, each nozzle having at least one pore or hole formed therein;

(b) supplying a charge, via a charge supplying means, to the one or more nozzles containing the fiber-forming media; and (c) collecting fibers formed from the one or more nozzles, wherein the one or more nozzles are formed from two mesh cylinders, a first mesh cylinder having a first interior diameter and a first exterior diameter, the first interior diameter and the first exterior diameter being different, and a second mesh cylinder having a second interior diameter and a second exterior diameter, the second interior diameter and the second exterior diameter being different, wherein the exterior diameter of the second mesh cylinder is less than the interior diameter of the first mesh cylinder such that the second mesh cylinder can be inserted into the interior of the first mesh cylinder.

13. The method of claim 12, wherein the one or more nozzles each have at least one cone, shelf or lip formed on an interior surface thereof.

14. The method of claim 12, wherein the one or more nozzles are cylindrical in shape.

15. The method of claim 12, wherein the one or more nozzles are independently polygon-shaped nozzles having at least three sides.

16. The method of claim 12, wherein the fibers are nanofibers.

17. The method of claim 16, wherein the nanofibers have an average diameter in the range of about 1 nanometer to about 25,000 nanometers.

18. The method of claim 16, wherein the nanofibers have an average diameter in the range of about 1 nanometer to about 10,000 nanometers.

19. The method of claim 16, wherein the nanofibers have an average diameter in the range of about 3 nanometers to about 3,000 nanometers.

* * * * *